US005185047A

United States Patent [19]

Ray

[11] Patent Number: 5,185,047

[45] Date of Patent: Feb. 9, 1993

[54] FRAMELESS GLASS-CERAMIC COOKTOP MOUNTING ASSEMBLY

[75] Inventor: Keith Ray, Delaware Township, Delaware County, Ohio

[73] Assignee: Whirlpool Corporation, Benton Harbor, Mich.

[21] Appl. No.: 709,263

[22] Filed: Jul. 1, 1991

Related U.S. Application Data

[62] Division of Ser. No. 444,719, Dec. 1, 1989, Pat. No. 5,036,831.

[51] Int. Cl.[5] ..... B32B 31/28; F24C 15/10

[52] U.S. Cl. ..... 156/242; 156/244.11; 156/244.17; 156/244.24; 156/272.2; 126/39 H; 126/211; 219/463; 219/464

[58] Field of Search ..... 156/244.11, 244.17, 156/244.24, 272.2, 242, 245; 126/39 J, 39 H, 39 R, 39 E, 39 F, 211; 219/443, 459, 460, 464, 466; 312/296, 140.2, 140.3; 108/42

[56] References Cited

U.S. PATENT DOCUMENTS

| | | | |
|---|---|---|---|
| 3,838,505 | 10/1974 | Doner | 219/463 |
| 3,870,862 | 3/1975 | Doner | 219/464 |
| 4,243,016 | 1/1981 | Kristen et al. | 126/211 |
| 4,363,956 | 12/1982 | Scheidler et al. | 219/264 |
| 4,453,533 | 6/1984 | Scheidler et al. | 219/211 |
| 4,490,603 | 12/1984 | Fischer et al. | 219/463 |
| 4,580,550 | 4/1986 | Kristen et al. | 126/39 J |

FOREIGN PATENT DOCUMENTS

| | | | |
|---|---|---|---|
| 3110087 | 9/1982 | Fed. Rep. of Germany | 126/211 |
| 3440868 | 6/1985 | Fed. Rep. of Germany | 126/39 H |

OTHER PUBLICATIONS

Moeller, "Trends in Glass-Ceramic Cooktops", Mar. 1988, Appliance Manufacturer.

Randolph, "Choosing Heating Elements for Glass--Ceramic Systems", Mar., 1988, Appliance Manufacturer.

*Primary Examiner*—Caleb Weston

*Attorney, Agent, or Firm*—Thomas J. Roth; Stephen D. Krefman; Thomas E. Turcotte

[57] ABSTRACT

A cooktop mounting assembly is set forth which utilizes a unitary ring member for supporting the periphery of a glass-ceramic panel as well as a method for assembling the same.

6 Claims, 2 Drawing Sheets

FRAMELESS GLASS-CERAMIC COOKTOP MOUNTING ASSEMBLY

This is a division of application Ser. No. 07/444,719, filed Dec. 1, 1989, now U.S. Pat. No. 5,036,831.

BACKGROUND OF THE INVENTION

1. Field of the Invention

The present invention relates to a cooktop assembly utilizing a unitary ring for supporting the periphery of a glass-ceramic panel and a method for assembling the cooktop assembly.

2. Description of the Related Art

Glass-ceramic cooktops and their associated mounting frames and trim are well known in the art. U.S. Pat. No. 4,453,533 discloses one of the known conventional mounting assemblies. Such a conventional mounting assembly includes a cooktop having a down-turned - out-turned frame including a peripheral external trim portion for supporting the glass-ceramic panel. Disadvantages associated with such designs include decreased cleanability, lack of an aesthetically pleasing appearance and the additional expense of providing an external trim portion.

Another conventional cooktop wherein the cooktop is of a trimless flush-mounted design is known from U.S. Pat. No. 4,363,956. Disadvantages with such a design are the requirements of a complex mounting frame for support of the glass-ceramic panel, the requirement that the sealant or grouting material be applied between the glass-ceramic panel and the cooktop after the glass-ceramic panel is installed in the cooktop, and the added material and manufacturing expense associated with these aspects of the cooktop.

A still further conventional cooktop wherein the cooktop is of a trimless flush-mounted design is known from U.S. Pat. No. 4,580,550. A disadvantage with such a design is the inability to preassemble the entire glass-ceramic panel sub-assembly and insert the resulting subassembly into the cooktop as a preassembled unit. A further disadvantage is the requirement that the glass-ceramic panel be permanently grouted or sealed into the cooktop after the glass-ceramic panel is installed in the cooktop, requiring additional manufacturing expense and preventing easy removal of the glass-ceramic panel for repair and replacement of heating units and associated components.

SUMMARY OF THE INVENTION

It is an object of the invention to provide a mounting assembly for a flush-mounted trimless glass-ceramic cooktop which overcomes the above-mentioned disadvantages and which provides for both simple and economical manufacture while providing an attractive surface appearance and finish. It is a further object of the invention to provide a mounting assembly for a glass-ceramic panel assembly which may be manufactured as a complete sub-assembly for insertion into the cooktop, thereby eliminating the additional manufacturing step of adjustment of the glass-ceramic panel height within the cooktop. A still further object of the invention is to provide a glass ceramic panel assembly which may include a pre-cured seal around the periphery of the glass-ceramic panel, thereby eliminating the additional manufacturing step of application of sealant or grout upon installation of the glass-ceramic panel assembly into the cooktop. A still further object of the invention is to provide a glass ceramic panel assembly which is easily removable from the cooktop or range for repair and replacement of heating units and associated components. A still further object of the invention is to provide a cooktop assembly having a durable periphery seal.

According to the invention, a cooktop or range includes a rectangular opening dimensioned slightly larger than that of the glass-ceramic panel that is to be mounted therein. Located along the periphery of the cooktop opening is a supporting down-turned flange with screw holes located at appropriate intervals.

A unitary support ring having a generally L-shaped cross section engages the periphery of the lower face of the glass-ceramic pane. A bead of silicone is located between the support ring and the glass-ceramic panel to secure the glass-ceramic panel to the support ring and insulate it from mechanical shock. A silicone layer is also formed around the edge of the glass-ceramic panel thereby providing a sealing and insulating layer between the glass-ceramic panel and the cooktop.

The silicone layer separating the glass-ceramic panel from the cooktop forms a flush layer between the two, eliminating the need for separate exterior trim or leveling apparatus. The support ring is secured to the cooktop using screws through holes in the support ring which are located at spaced intervals coinciding with the screw holes in the down-turned flange of the cooktop.

BRIEF DESCRIPTION OF THE DRAWINGS

Other objects, features and advantages of the invention will be best understood from the following detailed description taken in conjunction with the accompanying drawings, of which.

DESCRIPTION OF THE PREFERRED EMBODIMENTS

Figure 1:
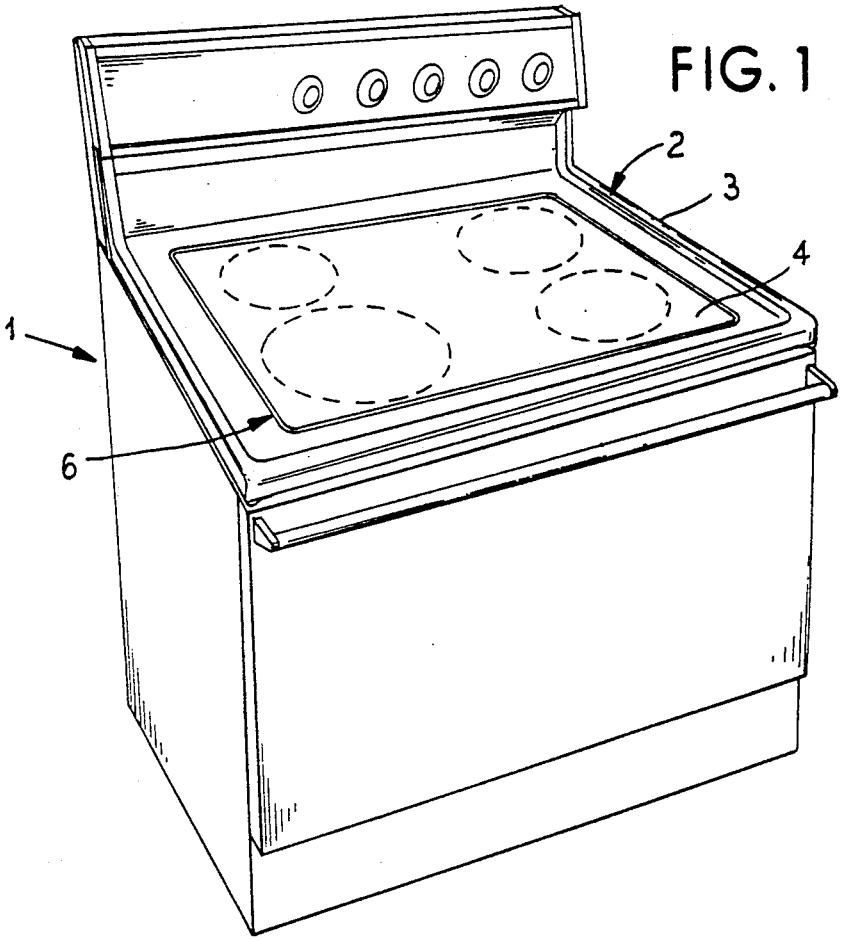
FIG. 1 is a perspective view of a range employing a preferred embodiment of the invention.
Figure 2:
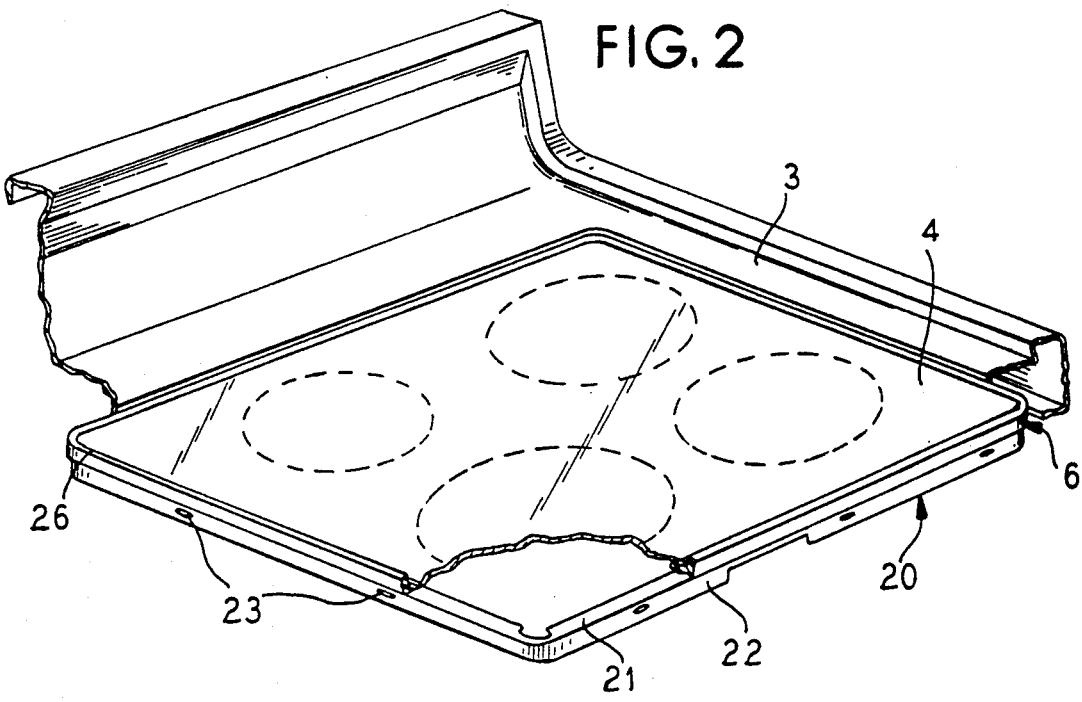
FIG. 2 is a perspective view of the present invention showing cut away sections which display several of the inventive features of the device.

Shown in FIG. 1 is a range 1 having a cooktop assembly 2 disposed thereon. Only a cooktop 3, a glass-ceramic panel 4 and a silicone seal 6 are exposed to the user's view when the assembly is installed.

Figure 3:
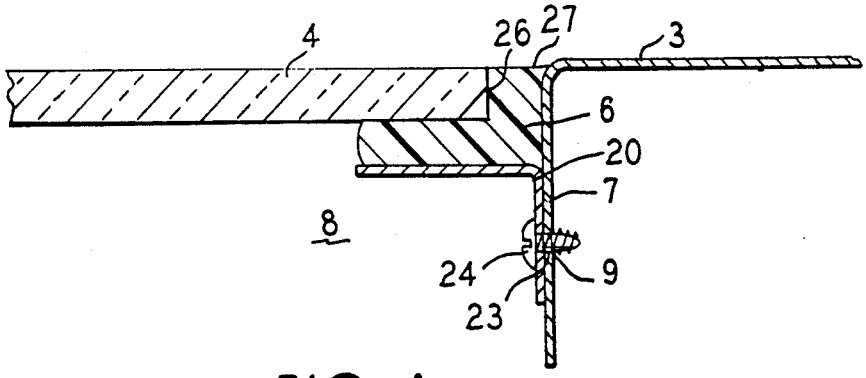
FIG. 3 is a sectional view of the present invention in accordance with one of the preferred assembly methods.
Figure 6:
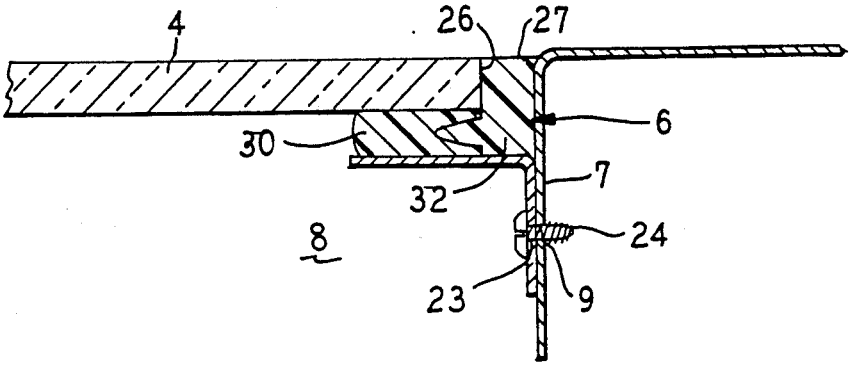

As shown in FIGS. 3 and 6, there is a down-turned flange 7 about the perimeter of a rectangular opening 8 within the cooktop 2. The opening 8 is dimensioned slightly larger than the glass-ceramic panel 4 which is to be placed therein. A screw hole 9 is shown disposed through the down-turned flange in FIGS. 3 and 6. Although the drawings show only a single screw hole 9 in the down-turned flange 7, there are multiple screw holes disposed in the flange at spaced intervals for providing substantially continuous support to the glass-ceramic panel 2, as is readily evident.

A support ring 20, preferably unitary, is utilized which is preferably constructed from stainless steel. The support ring 20 has an inverted L-shaped cross-section when it is properly oriented with the other components of the cooktop assembly. The L-shaped cross-section provides the support ring 20 with a first substantially flat exterior surface 21 and a second substantially flat exterior surface 22. Screw holes 23 are disposed along the second substantially flat exterior surface 22 at spaced intervals coinciding with the screw holes in the flange 7 on the cooktop 3. A screw 24 is placed through each of the screw holes 9,23 disposed respectively in the flange 7 of the cooktop 3 and the second substantially flat exterior surface 22 of the support ring 20 thereby to secure the support ring 20 to the cooktop 3. To facilitate mounting and to minimize the effects of manufacturing errors, the screw holes 23 in the second substantially flat surface 22 are preferably oblong thereby allowing adjustment of the position of the support ring 20 within the opening 8.

The silicone seal, shown generally at 6, is disposed between the first substantially flat exterior surface 21 of the unitary support ring 20 and the glass-ceramic panel 4 as well as between the peripheral edge 26 of the glass-ceramic panel 4 and the flange 7 thereby forming a bridging surface 27 between the glass-ceramic panel 4 and the cooktop 3. Thus, the silicone separating the glass-ceramic panel 4 and the cooktop 3 forms a flush layer and eliminates the need for separate exterior trim or leveling apparatus. The silicone disposed between the glass-ceramic panel 4 and the first substantially flat exterior surface 21 functions, inter alia, to adhere the glass-ceramic panel 4 to the unitary support ring 20. Although silicone is the material of preference, it will be understood by those skilled in the art that other sealing materials may also be utilized.

The glass-ceramic cooktop assembly 2 may be assembled using any of three different methods. As shown in FIG. 3, one of the assembly methods comprises first applying the silicone seal 6 to the support ring 20. After the support ring 20 is fastened to the flange 7 of the cooktop 3, the glass-ceramic panel 4 is inserted into the opening 8 of the cooktop 3 and the silicone seal 6 is allowed to cure.

Figure 4:
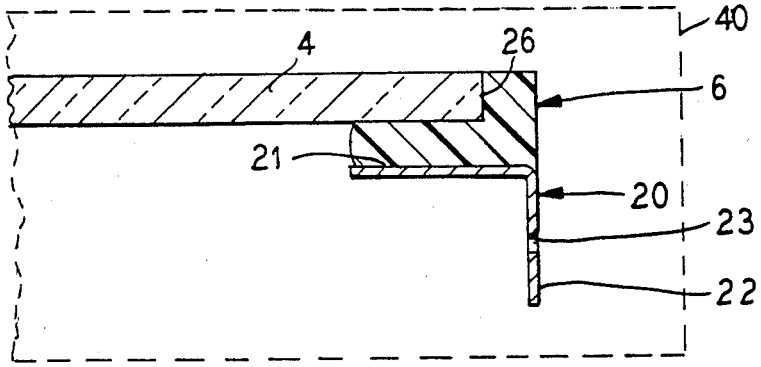
FIG. 4 is a sectional view of the glass-ceramic panel, silicone seal and support ring as constructed in accordance with one of the preferred assembly methods.

In a second method of assembly, as shown in FIG. 4, the glass-ceramic panel 4 is secured with silicone to the support ring 20 and pre-cured inside a mold 40 such that the silicone is formed to the desired shape for assembly. The entire sub-assembly comprising the pre-cured silicone seal 6, the glass-ceramic panel 4 and the unitary support ring 20 is then fastened to the flange 7 of the cooktop 3.

Figure 5:
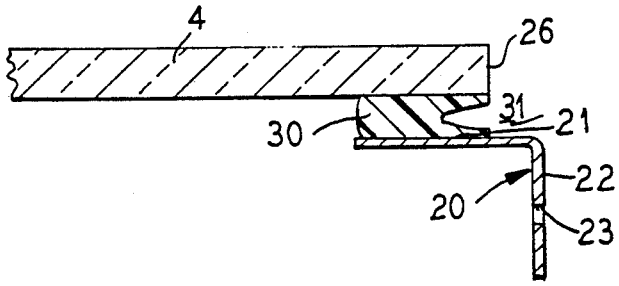
FIGS. 5 and 6 are sectional views of the present invention at various stages of construction in accordance with a still further assembly method.

In a third method of assembly, as shown in FIGS. 5 and 6, an amount of ultraviolet-curable silicone 30 is pre-cured between the glass-ceramic panel 4 and the support ring 20 and formed having a generally U-shaped cross-section. A void region 31 is thus created in the ultraviolet-curable silicone 30. The sub-assembly comprising the glass-ceramic panel 4, the ultraviolet-curable silicone 30 and the support ring 20 is then fastened to the flange 7 of the cooktop 3 at which time a further amount of silicone 32 is extruded into the resulting gap between the cook top 3 and the glass-ceramic panel 4. A portion of the further amount of silicone 32 enters the void region 31 of the pre-cured silicone 30 and the remainder of the silicone 32 seals the gap between the glass-ceramic panel 4 and the cooktop 3.

The result of each of the above-noted assembly methods is functionally and aesthetically the same. However, the latter two assembly methods are preferred since maximum advantage is taken of having a separate support ring for mounting the glass-ceramic panel within the cooktop.

As is apparent from the foregoing specification, the invention is susceptible of being embodied with various alterations and modifications which may differ particularly from those that have been described the preceding specification and description. It should be understood that we wish to embody within the scope of the patent warranted hereon all such modifications as reasonably and properly come within the scope of our contribution to the art.

I claim:

1. A method for assembling a planar cooktop panel into a generally planar cooktop surface comprising the steps of:

applying a sealing material to a first surface of a unitary support ring;

placing the planar cooktop panel in contact with said sealing material;

placing said planar cooktop panel, unitary support ring and sealing material in a mold, allowing said sealing material to cure, securing a second surface of said unitary support ring to a down-turning flange located about a periphery of an opening in a cooktop;

thereby securing said planar cooktop panel in said opening in said cooktop.

2. A method according to claim 1, wherein said sealing material is formed into a U-shaped cross-section having a void region by said mold and including the further step of extruding a further amount of said sealing material to fill a gap between said glass-ceramic panel and said down-turning flange and further to fill said void region of said U-shaped cross-section of said sealing material.

3. A method for assembling a cooktop assembly comprising the steps of:

securing a bottom face of a ceramic glass panel to a first substantially flat surface of a unitary support ring with a sealing material;

pre-curing said sealing material inside a mold;

securing a second substantially flat surface of said unitary support ring to a down-turning flange located about a perimeter of an opening in a cooktop thereby securing said glass-ceramic panel within said opening in said cooktop.

4. A method for assembling a cooktop assembly comprising the steps of:

securing a bottom face of a ceramic glass panel to a first substantially flat surface of a unitary support ring with an amount of a sealing material;

forming said sealing material into a U-shaped cross-section having a void region;

pre-curing said sealing material while in said general U-shape;

securing a second substantially flat surface of said unitary support ring to a down-turning flange located about a perimeter of an opening in a cooktop thereby securing said glass-ceramic panel within said opening in said cooktop, said glass-ceramic panel forming a gap with said down-turning flange; and extruding a further amount of said sealing material to fill said gap between said glass-ceramic panel and said down-turning flange and further to fill said void region of said U-shaped cross-section of said amount of sealing material; and curing said further amount of said sealing material.

5. A method of assembling a cooktop assembly as recited in claim 4 wherein said sealing material is silicone.

6. A method of assembling a cooktop assembly as recited in claim 5 wherein said silicone is pre-cured and cured using ultraviolet light.

* * * * *